US008325956B2

(12) United States Patent
Neher

(10) Patent No.: US 8,325,956 B2
(45) Date of Patent: Dec. 4, 2012

(54) HEARING DEVICE, HEARING AID SYSTEM, METHOD OF OPERATING A HEARING AID SYSTEM AND USE OF A HEARING AID DEVICE

(75) Inventor: Tobias Neher, Smørum (DK)

(73) Assignee: Oticon A/S, Smorum (DK)

( * ) Notice: Subject to any disclaimer, the term of this patent is extended or adjusted under 35 U.S.C. 154(b) by 913 days.

(21) Appl. No.: 12/371,218

(22) Filed: Feb. 13, 2009

(65) Prior Publication Data

US 2009/0208044 A1 Aug. 20, 2009

(30) Foreign Application Priority Data

Feb. 13, 2008 (EP) ..... 08101559

(51) Int. Cl.
*H04R 25/00* (2006.01)

(52) U.S. Cl. ..... 381/316; 381/320; 381/312; 381/23.1

(58) Field of Classification Search ..... 381/23.1, 381/312, 320, 321, 106, 316
See application file for complete search history.

(56) References Cited

U.S. PATENT DOCUMENTS 6,731,769 B1 5/2004 Lenhardt
2003/0044034 A1 3/2003 Zeng et al.
2006/0080087 A1 4/2006 Vandali et al.
2007/0003083 A1* 1/2007 Rikimaru ..... 381/312
2008/0319509 A1* 12/2008 Laback et al. ..... 607/57

FOREIGN PATENT DOCUMENTS

WO WO-2006/133431 A2 12/2006

* cited by examiner

*Primary Examiner* — Calvin Lee
*Assistant Examiner* — Scott Stowe
(74) *Attorney, Agent, or Firm* — Birch, Stewart, Kolasch & Birch, LLP

(57) ABSTRACT

A hearing device includes an input transducer positionable at an ear of a user for converting an acoustic input to the hearing device into an input signal, and a filter providing a source signal based on a source band of the input signal and for providing a target signal based on a target band of the input signal. The source band contains lower frequencies than the target band. A modulation envelope processor processes the source signal to generate a modulation envelope signal. A signal combiner combines the modulation envelope signal with the target signal from the target band, generating a target output signal. The hearing device may also include a signal processor for processing at least the target output signal and providing a processed output signal, and an output transducer for converting the processed output signal into an acoustic output to be provided to the ear of the user.

20 Claims, 5 Drawing Sheets

HEARING DEVICE, HEARING AID SYSTEM, METHOD OF OPERATING A HEARING AID SYSTEM AND USE OF A HEARING AID DEVICE

TECHNICAL FIELD

The present invention is related to a hearing device, a hearing aid system, a method of operating a hearing aid system and the use of a hearing device.

In particular the present invention is related to transformation of temporal fine structure-based information into temporal envelope-based information by means of hearing-aid signal processing.

BACKGROUND ART

In complex listening situations such as cocktail parties where there are a number of competing sources, normal-hearing listeners are known to rely on a variety of acoustical cues for extracting the individual component sources from a pair of ear-input signals, e.g. spatial or pitch cues [Bregman, A. S. (1990), "Auditory Scene Analysis—The Perceptual Organization of Sound," Cambridge, Mass.: The MIT Press, pp. 559-572, 590-594]. These cues may be conveyed by the detailed cycle-by-cycle or temporal fine structure properties as well as the more slowly varying temporal envelope properties of a waveform. Recent audiological research has shown that the ability of subjects with sensorineural hearing losses to make use of temporal fine structure-based information can be severely degraded, but that their sensitivity to temporal envelope-based information remains intact [Lorenzi, C., Gilbert, G., Carn, H., Garnier, S., and Moore, B. C. J. (2006), "Speech perception problems of the hearing impaired reflect inability to use temporal fine structure," Proc. Natl. Acad. Sci. USA, 103, 18866-18869; Lacher-Fougëre, S., and Demany, L. (2005), "Consequences of cochlear damage for the detection of interaural phase differences," J. Acoust. Soc. Am., 118, 2519-2526].

There is a large body of research dealing with human sound localization, which is reviewed in [Blauert, J. (1983), "Spatial Hearing," Cambridge, Mass.: The MIT Press]. This research has shown that normal-hearing listeners can utilize across-ear or interaural differences in temporal fine structure (so-called interaural phase differences; IPDs) when localizing frequencies lower than about 1.5 kHz. In addition, it has shown that they can utilize interaural differences in the temporal envelope (so-called interaural envelope delays; IEDs) of more complex, amplitude-modulated signals. Generally speaking, listeners are relatively insensitive to IEDs below 1.5 kHz, but at higher frequencies (e.g. between 2-4 kHz) sensitivity to them is much better [Blauert, pp. 153-154]. Furthermore, listeners are less sensitive to IEDs within high-frequency, complex stimuli than they are to changes in IPDs within low-frequency stimuli [Bernstein, L. R. (2001), "Auditory processing of interaural timing information: New insights," J. Neurosc. Res., 66, 1035-1046]. For complex broadband stimuli, therefore, IPDs seem to provide more potent localization information than IEDs (or interaural level differences for that matter [Wightman, F. L., and Kistler, D. J. (1992), "The dominant role of low-frequency interaural time differences in sound localization," J. Acoust. Soc. Am., 91, 1648-1661]).

DISCLOSURE OF INVENTION

To determine the reasons for the observed differences in potency, researchers started considering how the human auditory peripheral system affects different input signals [van de Par, S., and Kohlrausch, A. (1997), "A new approach to comparing binaural masking level differences at low and high frequencies," J. Acoust. Soc. Am., 101, 1671-1680]. To that end, a standard model of the processing taking place in the human inner ear, as described for example in [Bernstein (2001)], was employed. Such a model comprises a bank of overlapping bandpass filters that can simulate the frequency-selective properties of the basilar membrane. Each filter is followed by a halfwave rectifier as well as a lowpass filter with a cut-off frequency that is typically around 1-2 kHz. Passing signals with frequencies lower than the cut-off frequency of the lowpass filter through this model produces outputs that only consist of the positive values of the input waveforms (halfwave rectification). Passing signals with frequencies higher than the cut-off frequency of the lowpass filter through the model produces outputs that correspond to the envelopes of the input waveforms (envelope extraction). In qualitative terms, therefore, a low-frequency input signal results in an output with distinct "on" and "off" regions, whereas a high-frequency input signal results in an output that changes much more steadily, as indicated in FIG. 1*a*. This finding led to the hypothesis that it is the more abrupt properties or greater "peakedness" of the peripherally encoded low-frequency signal that can provide the human nervous system with more distinct timing cues. This, in turn, could explain the greater potency of low-frequency IPD cues compared to high-frequency IED cues that has been observed (see above). To illustrate, consider a low-frequency and a high-frequency input signal such as the ones shown in FIG. 1*a*. Now assume that both signals exhibit a given time delay $\Delta t$ across a listener's two ears (FIG. 1*b*). Due to its greater peakedness at the output of the human inner ear, the low-frequency input signal pair 5 gives rise to a pair of output signals 7 containing more obvious across-output signal differences than the high-frequency input signal pair 6. This is evident by comparing, for each pair of output signals (7, 8), the magnitudes of the leading (7.1, 8.1) and corresponding time-delayed (7.2, 8.2) signal. For example, at those points in time where the leading signal (7.1, 8.1) reaches its maximum, the across-output signal difference (v1, v2) is much larger for output signal pair 7 than for output signal pair 8. Consequently, the low-frequency input signal should be able to provide the human nervous system with more distinct timing cues than the high-frequency input signal. Furthermore, such timing cues should also be beneficial in situations where an interaural evaluation of temporal differences is not required, i.e. when perceptually salient information can be extracted from each ear-input signal separately. In other words, both binaural (e.g. sound localization) and monaural (e.g. pitch) hearing abilities should be served by the more distinct temporal cues that a low-frequency input signal gives rise to.

It should be noted that, within the context of this invention, the term 'peakedness' is used as a qualitative description of a signal's shape, and is e.g. taken to mean abruptness. It should also be noted that the halfwave rectification and lowpass filtering processes, which were already mentioned above, are generally used to model the transformations taking place in the inner hair cells [e.g. Dau, T., Püschel, D., and Kohlrausch, A. (1996), "A quantitative model of the 'effective' signal processing in the auditory system. I. Model structure," J. Acoust. Soc. Am., 99, 3615-3622; van de Par & Kohlrausch (1997)]. Since the efficacy of this invention depends somewhat on the occurrence of these transformations, it is important to realize that a typical sensorineural hearing loss leads to damaged outer hair cells; the inner hair cells, however, are much less vulnerable and remain therefore generally intact

[e.g. Moore, B. C. J. (2007), "Cochlear hearing loss," Chichester, UK: John Wiley & Sons Ltd, pp. 29-37]. Thus, the transformations they normally give rise to can still be expected to occur in most sensorineurally impaired ears.

In order to test the aforementioned "peakedness" hypothesis, a processing method was devised that allowed the generation of so-called transposed stimuli [van de Par & Kohlrausch (1997)]. These stimuli can provide the high-frequency (envelope-sensitive) channels of the human auditory system with envelope-based information that is very similar to the waveform-based information normally available only in the low-frequency (fine-structure-sensitive) channels. Generation of such stimuli involves multiplying a high-frequency carrier signal with a halfwave-rectified, lowpass-filtered low-frequency signal (see FIG. 2). If the resultant signal is then passed through the model of the human inner ear, the output will resemble closely the one obtained with a "conventional" low-frequency signal in terms of its peakedness (see FIG. 3).

Subsequent listening tests showed that sensitivity to temporal differences introduced interaurally into transposed stimuli was comparable to that achievable with low-frequency pure tones containing "conventional" IPD cues and substantially better than that achievable with high-frequency stimuli such as narrow bands of Gaussian noise and amplitude-modulated tones containing "conventional" IED cues [Bernstein, L. R., and Trahiotis, C. (2002), "Enhancing sensitivity to interaural delays at high frequencies by using transposed stimuli," J. Acoust. Soc. Am., 112, 1026-1036]. Similar performance improvements were also observed in tests of binaural detection [van de Par & Kohlrausch (1997)] and perceived lateral displacement [Bernstein, L. R., and Trahiotis, C. (2003), "Enhancing interaural-delay-based extents of laterality at high frequencies by using transposed stimuli," J. Acoust. Soc. Am., 113, 3335-3347]. These findings were interpreted as a confirmation of the assumed importance of a signal's peakedness at the output of the inner ear (greater peakedness giving rise to more distinct timing cues). Furthermore, they imply that the method developed to create transposed stimuli can be used to transform temporal fine structure-based cues into more distinct, envelope-based timing cues.

It is an object of the present invention to provide a hearing device, a hearing aid system and a method of operating a hearing aid system, which allow for an improved ability of hearing aid users to access temporal fine structure cues. In an embodiment of the invention, the extraction of an individual acoustic source among a number of competing sources is facilitated.

In order to achieve said object, according to the present invention a hearing device is proposed, comprising an input transducer arrangeable at an ear of a user for converting an acoustic input to the hearing device into an (electric) input signal, a filtering means for providing a source signal based on a source band of said input signal and for providing a target signal based on a target band of said input signal, wherein said source band contains lower frequencies than said target band, a modulation envelope means for processing said source signal to generate a modulation envelope signal, and a signal combination means for combining the modulation envelope signal with said target signal to generate a target output signal. It is intended that the source and target signals comprise frequencies of the source and target bands, respectively.

Given the reduced ability of hearing-impaired subjects to access (low-frequency) temporal fine structure cues as well as their intact ability to access (higher-frequency) temporal envelope cues, this invention seeks to encode temporal fine structure-based information in the temporal envelopes of higher-frequency carriers by multiplying such carriers with (possibly pre-processed) low-frequency hearing-aid input signals serving as modulation envelopes. By transforming temporal fine structure-based information into temporal envelope-based information by means of hearing-aid signal processing, the ability of hearing-aid users to access temporal fine structure-based cues can be improved.

Due to the fact that, in situations where a hearing aid user's binaural hearing abilities are to be improved, the transformed cues have to be interaurally compared so that they can provide binaurally meaningful information, an implementation that is intended to transform IPDs is suitable only for bilateral fittings where the same type of processing is performed in the user's two hearing aids. Conversely, in situations where monaural hearing abilities are to be improved and/or where only one hearing aid is available, the same type of processing can be performed unilaterally.

Since considerable amounts of research have dealt with the perceptual effects of transforming IPD cues (see above), the proposed processing method lends itself especially to transforming these types of cues. However, as already indicated above, it should also be possible to use the processing architecture of the present invention to improve the ability of hearing-impaired subjects to access other acoustical cues that are conveyed by temporal fine structure-based information, e.g. pitch cues. There is universal agreement that pitch is a correlate of the periodicity of a sound's waveform. A tone that has been processed by the human inner ear excites the auditory nerve at a particular place and induces a neural response that is modulated temporally at a rate equaling the frequency of that tone [e.g. Shamma, S. A. (2004), "Topographic organization is essential for pitch perception," Proc. Natl. Acad. Sci. USA, 101, 1114-1115]. There are suggestions in the literature that for a given input stimulus the auditory system extracts timing information available from these modulations by means of autocorrelation analyses that enable it to extract the underlying periodicities [e.g. Meddis, R., and O'Mard, L. (1997), "A unitary model of pitch perception," J. Acoust. Soc. Am., 102, 1811-1820]. These periodicities are assumed to be measured in parallel in all auditory-nerve channels. The pitch of the stimulus is then determined by pooling all measurements and selecting the fundamental period common to all channels. By using a (possibly pre-processed) low-frequency target band to modulate a higher-frequency source band, information about periodicity contained in the source band can be encoded in the envelope of the target band in the same way as low-frequency IPD cues are encoded in the interaural envelopes of higher-frequency carriers. Given the inability of some hearing-impaired subjects to exploit low-frequency temporal fine structure-based information, such processing should make it possible to enhance pitch perception for them.

According to a preferred embodiment of the present invention, said source band is arranged at frequencies lower than 1.5 kHz, preferably lower than 500 Hz. Ideally, this source band or source channel should be located as low in frequency as possible, e.g. lower than 300 Hz. This is because of psychophysical and neurophysiologic indications that the human auditory system becomes insensitive to envelope fluctuations that occur at rates higher than a few hundred Hertz [Bernstein, L. R., and Trahiotis, C. (1994), "Detection of interaural delay in high-frequency sinusoidally amplitude-modulated tones, two-tone complexes, and bands of noise," J. Acoust. Soc. Am., 95, 3561-3567; Dreyer, A., and Delgutte, B. (2006), "Phase locking of auditory-nerve fibers to the envelopes of high-frequency sounds: Implications for sound localization," J. Neurophysiol., 96, 2327-2341].

In a further embodiment of the invention, said target band is in the range of 2 kHz to 4 kHz. A target band is preferably chosen falling into a frequency range of about 2-4 kHz (e.g. from 2.5-3.5 kHz) because sensitivity to cues, in particular to IED cues, is assumed to be very good for carrier frequencies that fall into that frequency range.

In a particular embodiment, the frequency range of interest $\Delta f$ considered by the hearing device comprises the human audible frequency range, e.g. frequencies between 5 Hz and 20 kHz, such as between 10 Hz and 10 kHz. In an embodiment, the frequency range of interest is split into a number of frequency bands $FB_i$ ($i=1, 2, \ldots, n_b$), e.g. $n_b=8$ or 16 or 64 or more (where each band may be individually processed by a signal processor of the hearing device). In an embodiment, the hearing device comprises a filterbank splitting the electrical input signal into a number of signals, each comprising a particular frequency band $FB_i$ ($i=1, 2, \ldots, n_b$), where $n_b$ can be any relevant number larger than 1, e.g. $2^n$, where n is an integer $\geqq 1$, e.g. 6. In an embodiment, the source band is one of the lower frequency bands (e.g. one of the three lowest such as the lowest frequency band considered) comprising the lower part of the frequency range of interest.

According to another embodiment of the invention, said filtering means are adapted for providing a plurality of filter signals based on a plurality of filter bands, wherein said source band and/or said target band are selected from said filter bands based on a monitoring of said filter signals.

In general, the target band is selected based on considerations of residual hearing sensitivity of the hearing-impaired subject, so that the transformed source-band cues are made available in a frequency region the subject still has adequate access to. Advantageously, the target band is, additionally or alternatively, selected based on considerations related to the region of best sensitivity to temporal envelope-based cues. Furthermore, the selection of suitable source and target bands may be performed in both a static and a dynamic fashion. A static implementation of the algorithm does not require any ongoing estimation of the most suitable source and/or target bands; instead, both types of bands are initially determined and then kept. By contrast, a dynamic implementation involves (possibly continuous) monitoring of the signals contained in different filterbank channels. Based on the detected signals, the most suitable combination of source and target bands is then determined.

In a yet further embodiment of the invention, said modulation envelope means are adapted for applying halfwave rectification and lowpass filtering to said source signal to generate said modulation envelope signal, wherein the cut-off frequency of said lowpass filtering may be in the range of 1 kHz to 2 kHz. This allows for a simple implementation of a means for generating a suitable modulation envelope that is in accordance with the processing taking place in the human inner ear.

According to an advantageous embodiment of the present invention, said modulation envelope means are adapted in such a way that they enable better control over the temporal characteristics of the modulation envelope signal. One possibility for such adapted modulation envelope means entails raising a DC-shifted modulator to an exponent greater than or equal to one prior to multiplication with a carrier [John, M. S., Dimitrijevic, A., and Picton, T. (2002), "Auditory steady-state responses to exponential modulation envelopes," Ear Hear., 23, 106-117]. This method is more flexible than halfwave rectification and lowpass filtering in that it allows one to manipulate the temporal characteristics of a modulation envelope as well as to trade these off against the spectral content of the resultant signal. To illustrate, increasing the exponent to which the modulator signal is raised leads to a stimulus with greater peakedness as well as more sidebands. Greater control over peakedness is advantageous, since peakedness has been found to influence listener performance in tests of sensitivity to and perceived lateral displacement of transposed IPD cues [Bernstein, L. R., and Trahiotis, C. (2006), "Enhanced processing of interaural temporal disparities at high-frequencies: Beyond transposed stimuli," Proc. 14th Int. Symp. Hear., Cloppenburg, Germany, Aug. 18-23, pp. 368-374].

In another embodiment of the present invention said signal combination means are adapted for multiplying said modulation envelope signal with a higher-frequency (e.g. a carrier) signal.

In a preferred embodiment, the signal combination means are adapted for providing said higher-frequency signal in the form of a carrier signal for adding said multiplied modulation envelope signal to said target signal to generate said target output signal.

In the present context, the term 'a higher-frequency signal' is a signal comprising one or more frequency components that are higher in frequency than the highest frequency component contained in the modulation envelope signal. In an embodiment, a higher-frequency signal is a carrier signal. In an embodiment, the carrier signal is a periodic signal, possibly containing a single (sinusoidal) frequency.

According to a further embodiment of the invention, said signal combination means are adapted for multiplying said modulation envelope signal with said target signal to generate said target output signal.

In a yet further embodiment of the invention said signal combination means include means for gain adjustment and/or filtering upon said generation of said target output signal. Additional gain adjustment enables control over the level of the transformed cues in the target band. Additional filtering enables control over the amount of sideband energy introduced by performing non-linear operations such as halfwave rectification.

In a particular embodiment, the hearing device comprises a signal processor adapted to process a signal in a number of frequency bands, including said target band (and optionally said source band), and for providing a processed output signal based on the processed signals of said number of frequency bands. In an embodiment, the signal processor is adapted to be able to process the majority, such as all, of the frequency bands of the frequency range of interest of the input signal, e.g. the majority or all of the frequency bands that are generated by the filtering means.

In a particular embodiment, the hearing device comprises an output transducer for converting the processed output signal into an acoustic output to be provided to the ear of the user (when the device is located in its operational position).

Furthermore, a hearing aid system comprising a first and a second hearing device according to the present invention (as described above, in the detailed description and in the claims) is provided.

It is intended that the features of the hearing device described above, in the detailed description and in the claims can be combined with the methods described below, in the detailed description and in the claims (where appropriate and converted into a corresponding process or activity).

In an aspect, a method of configuring a hearing aid system is furthermore proposed, the method comprising the steps of converting a first acoustic input at a first ear of a user into a first (electric) input signal, providing a first source signal based on a first source band of said first input signal and providing a first target signal based on a first target band of said first input signal, wherein said first source band contains lower frequencies than said first target band, processing said first source signal to generate a first modulation envelope signal, combining said first modulation envelope signal with said first target signal to generate a first target output signal.

In an aspect, a method of configuring a hearing aid system is furthermore proposed, the method comprising the steps of converting a first acoustic input at a first ear of a user into a first input signal, converting a second acoustic input at a second ear of a user into a second input signal, providing a first source signal based on a first source band of said first input signal and providing a first target signal based on a first target band of said first input signal, wherein said first source band contains lower frequencies than said first target band, providing a second source signal based on a second source band of said second input signal and providing a second target signal based on a second target band of said second input signal, wherein said second source band contains lower frequencies than said second target band, processing said first and second source signals to generate first and second modulation envelope signals, respectively, combining said first modulation envelope signal with said first target signal to generate a first target output signal, and combining said second modulation envelope signal with said second target signal to generate a second target output signal.

In a particular embodiment, the method further comprises a step of processing signals from a first number of frequency bands, including said first target output signal of said first target band, and for providing a first processed output signal based on the processed signals of the first number of frequency bands. Preferably the first number of signals being processed also includes the first source signal. The processing typically involves adapting the input signals to the specific needs of a user in the various frequency bands, as regards e.g. gain and compression.

In a particular embodiment, the method further comprises processing signals from a second number of frequency bands, including said second target signal of said second target band, and for providing a second processed output signal based on the processed signals of said second number of frequency bands. Preferably the second number of signals being processed also includes the second source signal.

In a particular embodiment, the method further comprises converting said first and/or second processed output signal(s) into respective said first and/or second acoustic output(s) to be provided to respective said first and/or second ear(s) of said user.

In a particular embodiment, the method further comprises that the target band is chosen based on considerations of the user's hearing thresholds and/or on considerations of the user's best sensitivity to temporal envelope-based cues. This has the advantage of further optimizing the improvement to the particular user.

In an aspect of the invention, use of a hearing device as described above, in the detailed description and in the claims in a bilateral hearing aid system comprising first and second hearing devices is furthermore provided. In a preferred embodiment, both hearing devices of the bilateral hearing aid system are hearing devices as described above, in the detailed description and in the claims.

In an aspect of the invention, use of a hearing device as described above, in the detailed description and in the claims in a unilateral hearing aid system comprising only one hearing device is furthermore provided. In a preferred embodiment, the hearing device of the unilateral hearing aid system is a hearing device as described above, in the detailed description and in the claims.

A software program for running on a signal processor of a hearing device is furthermore provided, the software program being adapted to—when executed on the signal processor—implement at least some of the steps of the method described above, in the detailed description and in the claims. Preferably at least one of the steps of the method for processing the signal from a source band to provide a target output signal based on the signal from a target band is implemented in the software program. In an embodiment, the hearing device is a hearing device as described above, in the detailed description and in the claims.

A medium having instructions stored thereon is furthermore provided. The stored instructions, when executed, cause a signal processor of a hearing device as described above, in the detailed description and in the claims to perform at least some of the steps of the method as described above, in the detailed description and in the claims. Preferably at least one of the steps of the method for processing the signal from a source band to provide a target output signal based on the signal from a target band is included in the instructions. In an embodiment, the medium comprises a non-volatile memory of the hearing device. In an embodiment, the medium comprises a volatile memory of the hearing aid.

Further objects of the invention are achieved by the embodiments defined in the dependent claims and in the detailed description of the invention.

As used herein, the singular forms "a," "an," and "the" are intended to include the plural forms as well, unless explicitly stated otherwise. It will furthermore be understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

BRIEF DESCRIPTION OF DRAWINGS

In the following, the present invention is further explained based on preferred embodiments referring to the accompanying figures, in which.

DETAILED DESCRIPTION

Figure 1A:
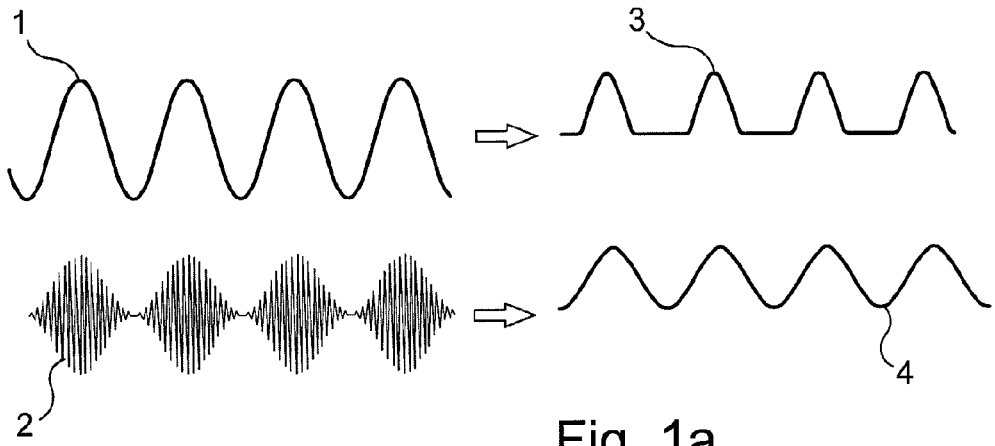
FIG. 1 illustrates the effects the human inner ear has on a low-frequency sinusoid and a high-frequency sinusoid amplitude-modulated with the low-frequency sinusoid (FIG. 1*a*) as well as on pairs of these two types of input signals that are interaurally delayed by Δt seconds (FIG. 1*b*)

FIG. 1*a* illustrates the effects the human inner ear has on two different input signals. More precisely, a low-frequency (e.g. 250-Hz) sinusoid 1, 3 and a high-frequency (e.g. 4-kHz) sinusoid amplitude-modulated with the low-frequency sinusoid 2, 4 are shown before (1, 2) and after (3, 4) passing them through a standard model of the human inner ear [cf. e.g. Bernstein (2001)]. As can be seen, the model's effect on the low-frequency sinusoid is to halfwave-rectify it, producing an output with distinct "on" and "off" regions and hence very abrupt changes. In contrast, passing the high-frequency, amplitude-modulated sinusoid through the model leads to the extraction of its envelope, which corresponds to a signal that changes much more steadily compared to the halfwave-rectified low-frequency sinusoid.

Figure 1B:
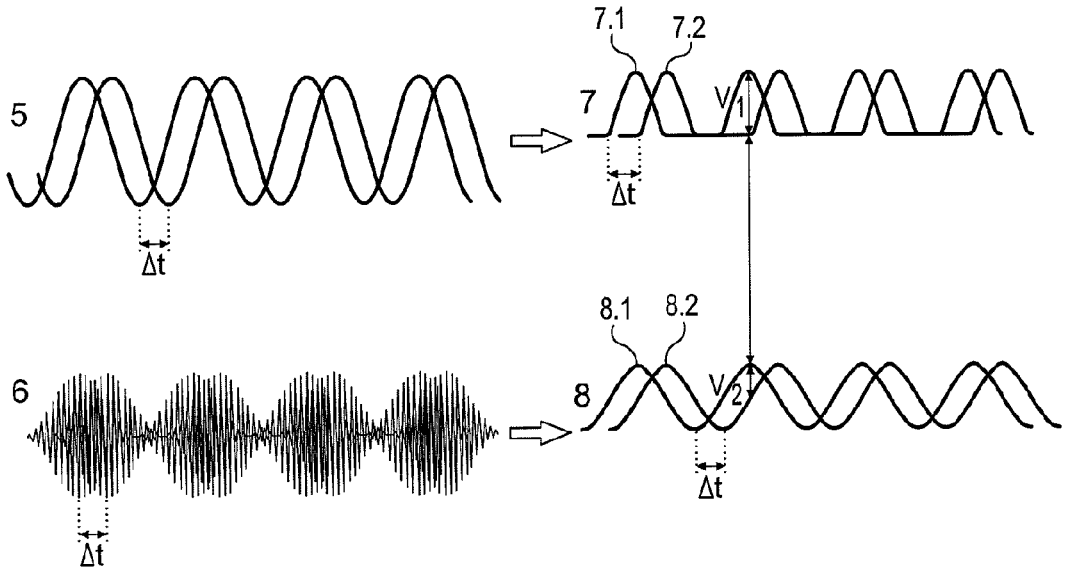

FIG. 1*b* is an extension of FIG. 1*a* in that it illustrates the situation where each of the two input signals 1, 2 from FIG. 1*a* exhibits a delay of Δt seconds across a listener's two ears, thereby giving rise to two pairs of ear-input signals 5, 6. More precisely, a pair of interaurally delayed low-frequency sinusoids 5, 7 and a pair of interaurally delayed high-frequency sinusoids amplitude-modulated with the low-frequency sinusoid 6, 8 are shown before (5, 6) and after (7, 8) passing them through a standard model of the human inner ear. As a result of halfwave rectification, output signal pair 7 is characterized by distinct "on" and "off" regions and hence very abrupt changes. In contrast, as a result of envelope extraction, output signal pair 8 is characterized by much more gradual changes. Importantly, the greater abruptness of output signal pair 7 gives rise to more pronounced across-output signal differences. This is apparent by comparing, for each pair of output signals (7, 8), the magnitudes of the leading (7.1, 8.1) and corresponding time-delayed (7.2, 8.2) signal. For example, at those points in time where the leading signal (7.1, 8.1) reaches its maximum, the across-output signal difference (v1, v2) is much larger for output signal pair 7 than for output signal pair 8. In this context, it is pointed out once more that, for normal-hearing persons, output signal pair 7 provides more potent interaural temporal information than output signal pair 8 and that persons affected by a sensorineural hearing loss are better able to extract interaural temporal information from input signal pair 6 than from input signal pair 5.

Figure 2:
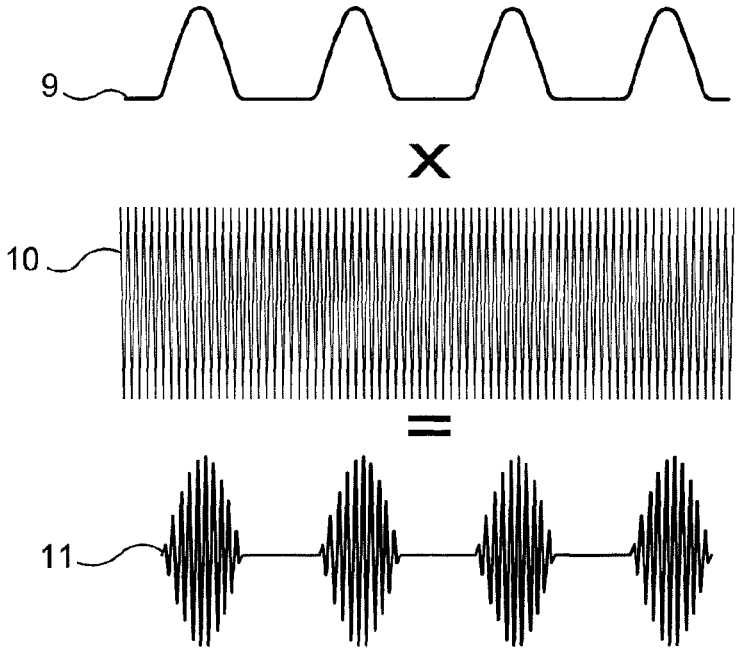
FIG. 2 is a schematic diagram showing the generation of a "transposed" stimulus.

FIG. 2 is a schematic diagram showing the generation of a "transposed" stimulus 11, wherein a halfwave-rectified low-frequency (e.g. 250-Hz) tone 9 (see also signal 3 in FIG. 1*a*) is multiplied with a high-frequency (e.g. 4-kHz) carrier 10 to provide the transposed stimulus 11. As can be seen, amplitude-modulating the high-frequency carrier with the halfwave-rectified low-frequency tone leads to a signal (the transposed stimulus) that resembles output signal 3 (FIG. 1*a*) in so far as it also exhibits distinct "on" and "off" regions and hence very abrupt changes.

Figure 3:
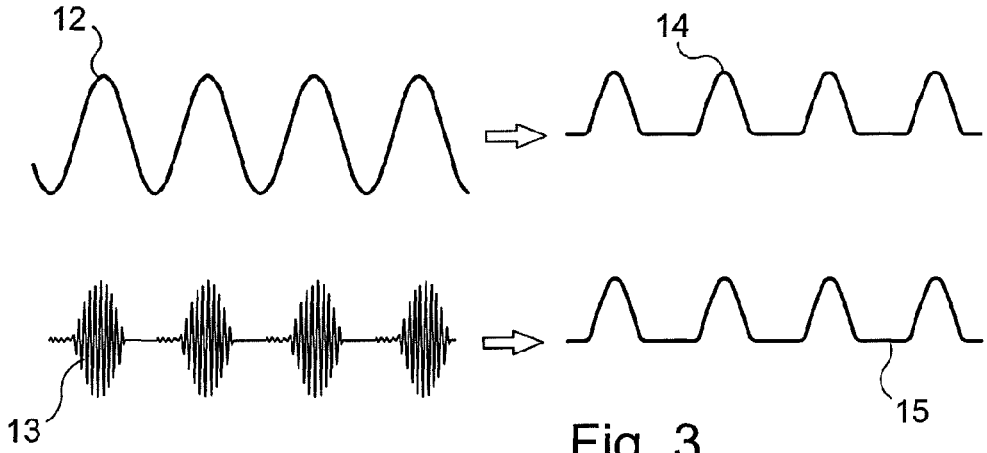
FIG. 3 illustrates the effects the human inner ear has on a low-frequency sinusoid and a transposed stimulus input signal.

FIG. 3 illustrates the effects the human inner ear has on a low-frequency sinusoid and a transposed stimulus input signal. More precisely, a low-frequency sinusoid 12, 14 and a transposed stimulus 13, 15 created according to FIG. 2 are shown before (12, 13) and after (14, 15) passing them through a standard model of the human inner ear. As can be seen, the transposed stimulus gives rise to an output signal that resembles the one from the low-frequency sinusoid closely, i.e. both output signals exhibit distinct "on" and "off" regions and hence very abrupt changes. It is therefore apparent that, by processing a low-frequency signal in accordance with a method proposed to generate transposed stimuli, a signal can be produced that, on the input side of the human inner ear, possesses temporal characteristics that persons affected by a sensorineural hearing loss still have access to. Importantly, when this signal is passed through a human inner ear with sufficiently functional inner hair cells, then its temporal characteristics are transformed in such a way that they (on the output side) take on a form which is known to be perceptually advantageous. In this context, it is pointed out once more that the functionality of the inner hair cells generally is not impaired by a typical sensorineural hearing loss.

Figure 4A:
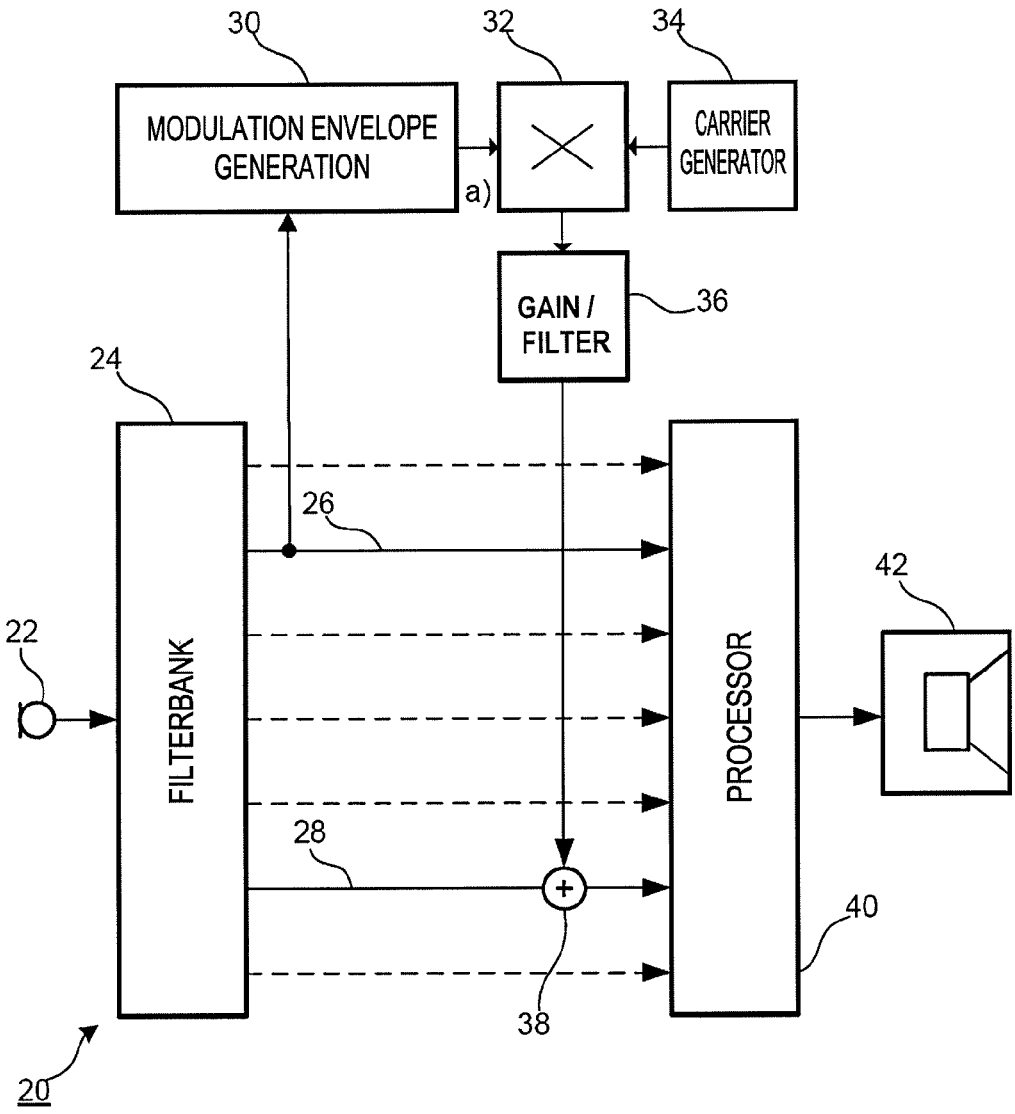
FIG. 4 represents simplified hearing-aid block diagrams showing the signal processing carried out according to two different embodiments of the present invention (FIG. 4*a* and FIG. 4*b*)
Figure 4B:
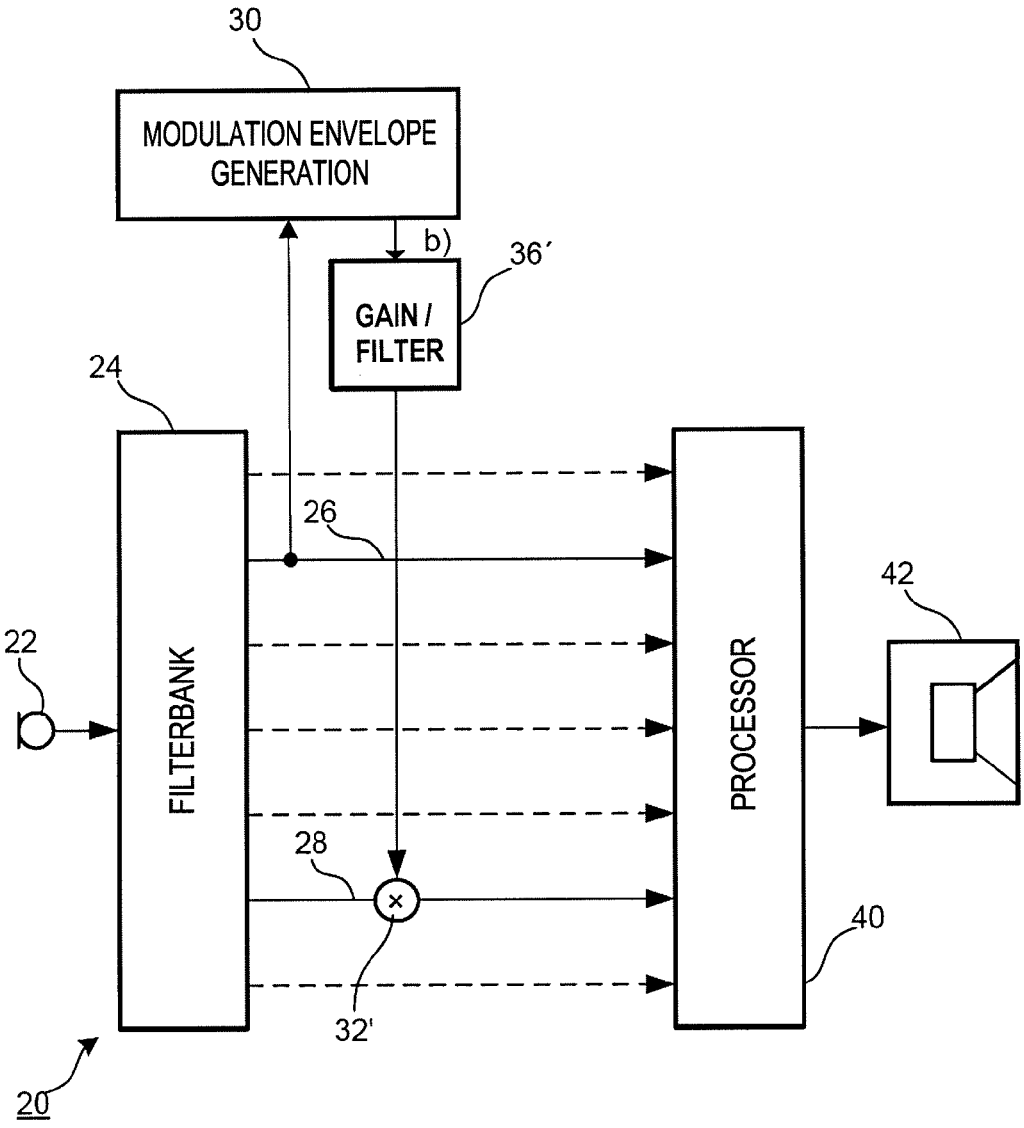

FIG. 4*a* and FIG. 4*b* represent simplified hearing-aid block diagrams showing the signal processing carried out according to embodiments of the present invention to transform low-frequency temporal fine structure-based cues into high-frequency temporal envelope-based cues. The way in which temporal fine structure cues may be transformed into temporal envelope cues in a hearing-aid context of the present invention is illustrated schematically in the two different embodiments of FIG. 4. In the embodiments of FIGS. 4*a* and 4*b*, the hearing device 20 comprises a microphone or input transducer 22 for converting an acoustic input into an electric input signal, a filtering means 24 in the form of a filterbank for splitting the frequency range of interest of the input signal into a number of frequency bands $FB_i$, and a modulation envelope means 30 for generating a modulation envelope signal. The hearing device further comprises a signal processor 40 for processing a number of frequency bands $FB_i$ and for providing a (single) processed output signal and an output transducer 42. The input transducer 22 is coupled to the filterbank 24. A source signal based on a source band 26 and a target signal based on a target band 28 are defined. At least one output of the filterbank 24 (the signal from source band 26) is coupled to the modulation envelope means 30. At least one output of the filterbank (the signal from target band 28) is modified by the modulation envelope signal. The outputs of the filterbank 24 are either directly coupled to the signal processor 40 or modified and coupled to the signal processor 40 (one or more filterbank outputs, including the target signal from target band 28, are appropriately modified to generate one or more modified filterbank output signals that are fed to the signal processor 40). An output of the signal processor 40 is provided to the output transducer 42 for being converted into an acoustic output. Possible conversion from analogue to digital form can e.g. be included in the input transducer 22 or in the filterbank 24. Possible conversion from digital to analogue form can e.g. be included in the output transducer 42 or in the signal processing unit 40.

The embodiments of FIG. 4*a* and FIG. 4*b* show two different solutions for the generation of a modified target output signal to be fed to the signal processor 40.

FIG. 4*a* shows an embodiment, where the modulation envelope signal from the modulation envelope means 30 is multiplied in a first multiplication circuit 32 by a carrier signal from a carrier generator 34. The resulting modulated signal from the first multiplication circuit 32 is added to the target signal from target band 28 via adding circuit 38. This signal can be fed to the signal processing unit 40 for adaptation to a user's needs. The carrier generator can e.g. be an ordinary signal generator, e.g. a generator of sinusoidal signals. In the embodiment shown in FIG. 4*a*, the resulting modulated signal from the first multiplication circuit 32 is coupled to the adding circuit 38 via first gain adjustment (to control e.g. the level of the transformed temporal cues in the target band) and/or filtering (to control e.g. the amount of sideband energy introduced by performing non-linear operations such as halfwave rectification) means 36.

In the embodiment of FIG. 4*b*, the modulation envelope signal from the modulation envelope means 30 is multiplied in a second multiplication circuit 32' with the signal in target band 28 itself and the resulting target output signal is fed to a signal processing unit 40. In the embodiment of FIG. 4*b*, the modulation envelope signal is coupled to the multiplication circuit 32' via second gain adjustment and/or filtering means 36'.

The method implemented by the embodiments of FIGS. 4*a* and 4*b* can be briefly summarized as follows: An acoustic signal that is captured by a microphone or input transducer 22 of a hearing device 20 is passed through a filterbank 24 implemented in the hearing device 20 and provided as a filtering means 24. At least one low-frequency channel of the filterbank 24 is used as source band 26. The signal from source band 26 is supplied to the modulation envelope means 30. Modulation envelope processing such as halfwave rectification and lowpass filtering is performed on the source signal by the modulation envelope means 30. Alternatively, the modulation envelope means 30 are adapted, so that they allow for greater control over the temporal characteristics of the modulation envelope signal. This could be achieved, for example, by using a method that entails raising a DC-shifted modulator to an exponent greater than or equal to one. The resultant processed source signal (the modulation envelope signal) is then e.g. multiplied with a carrier that corresponds to a separately generated higher-frequency signal. The multiplication result is added—after optional gain adjustment and/or filtering—to the output of a higher-frequency channel serving as target band 28 whereby a target output signal is provided. Alternatively or in addition to the above, the processed source signal (the modulation envelope signal) is multiplied with the signal already contained in target band 28, again after optional gain adjustment and/or filtering. The modified target band signal 28 (the target output signal) is provided to the signal processor 40 for further processing, possibly together with signals from other frequency bands. The signal processor 40 then supplies an output signal to the output transducer 42 to generate an acoustic output which is provided to an ear of a user (not shown).

Figure 5:
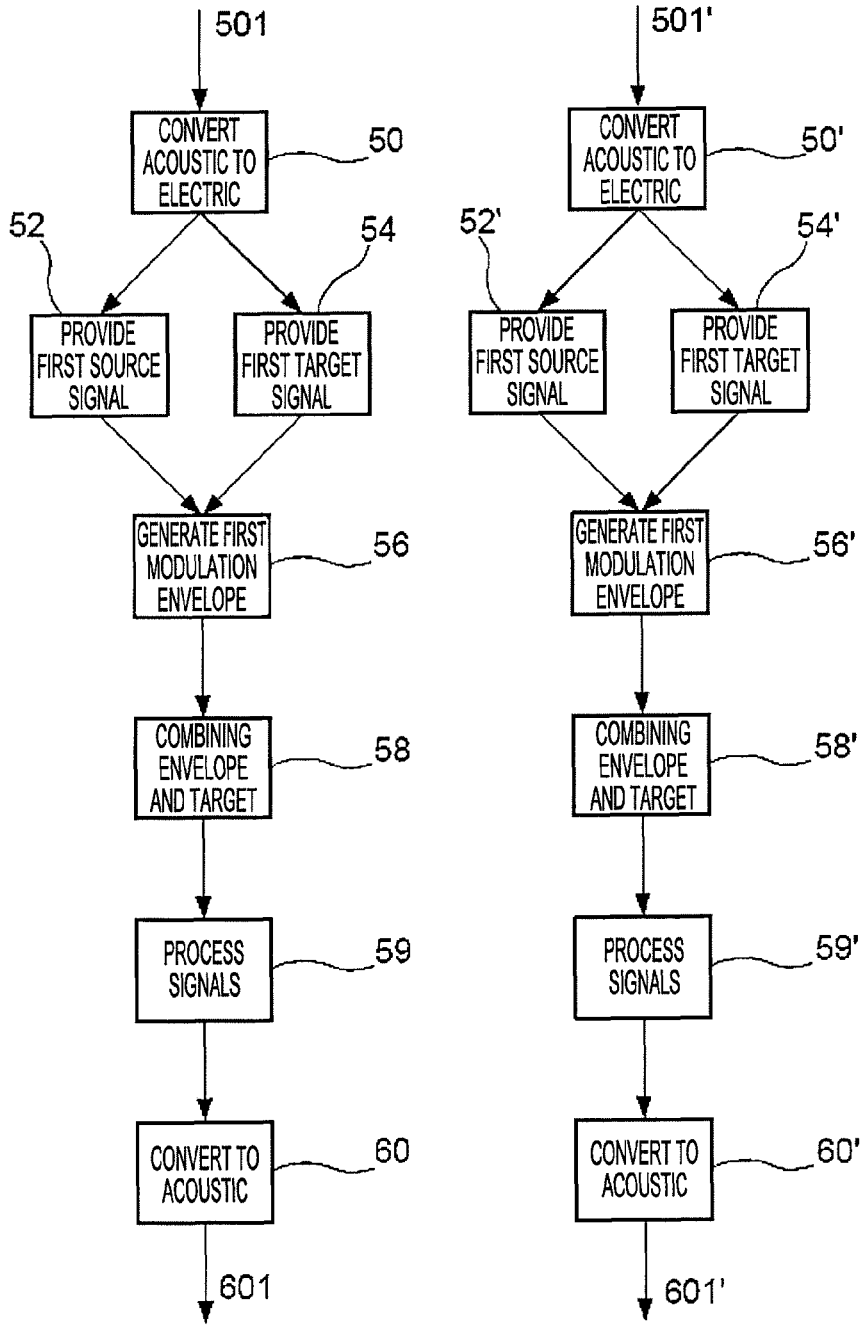
FIG. 5 is a schematic flow chart of a method according to an embodiment of the present invention, illustrating a bilateral application.

FIG. 5 is a schematic flow chart of a method according to an embodiment of the present invention. In a first hearing device the following steps are performed: converting 50 a first acoustic input 501 at a first ear of a user into a first (electric) input signal, providing 52 a first source signal based on a first source band of said first input signal and providing 54 a first target signal based on a first target band of said first input signal, wherein said first source band contains lower frequencies than said first target band, processing 56 said first source signal to generate a first modulation envelope signal, combining 58 said first modulation envelope signal with said first target signal to generate a first target output signal, processing 59 the signals of at least the first source and target bands to provide a first processed output signal, and converting 60 said first processed output signal into a first acoustic output 601 to be provided to one ear of said user. In parallel to this, corresponding steps of converting 50' a second acoustic input 501' at a second ear of a user into a second (electric) input signal, providing 52' a second source signal based on a second source band of said second input signal and providing 54' a second target signal based on a second target band of said second input signal, wherein said second source band contains lower frequencies than said second target band, processing 56' said second source signal to generate a second modulation envelope signal, combining 58' said second modulation envelope signal with said second target signal (cf. 28 in FIG. 4) to generate a second target output signal, processing 59' the signals of at least the second source and target bands to provide a second processed output signal, and converting 60' said second processed output signal into a second acoustic output 601' to be provided to the other ear of said user are performed in a second hearing device. The method may be used in unilateral applications as well, as illustrated by the left part of FIG. 5 (reference numerals, 501, 50, . . . , 60, 601) for a single hearing device.

EXAMPLE

The utility of the invention outlined above can be illustrated by means of the following, non-limiting example. A person with a sensorineural hearing loss (but sufficiently functional inner hair cells) typically has reduced abilities to extract, and therefore to use the information conveyed by, the temporal fine structure of an ear-input signal. However, such a person generally has adequate residual abilities to extract, and therefore to use the information conveyed by, the temporal envelope of an ear-input signal. The processing algorithm outlined above is intended to transform temporal fine structure-based cues into temporal envelope-based cues. Hence, by fitting a hearing-impaired person with at least one hearing aid that has been configured to perform this type of processing, that person's ability to benefit from information conveyed by the temporal fine structure of an ear-input signal can be improved. To be more specific, a low-frequency source band is chosen (either just once initially in the case of a static implementation or continuously in the case of a dynamic implementation) containing the temporal fine structure-based cues that are to be made accessible again, e.g. a frequency band centred around 250 Hz. Based on the method proposed to create trans-posed stimuli or a variant thereof, the signal from this source band is transformed into a modulation envelope signal. This modulation envelope signal is then multiplied with a higher-frequency target band that serves as a carrier signal and that has been chosen according to the person's hearing thresholds as well as according to the region of best sensitivity to temporal envelope-based cues. If the person has a low hearing threshold and therefore good remaining hearing sensitivity around 2 kHz, for example, then a target band with a centre frequency of around 2 kHz would be a good choice. In principle, instead of initially determining and then keeping it, the selected target band could also be updated over time. Furthermore, instead of multiplying the modulation envelope signal directly with the signal from the target band, it is also possible to multiply it with a separately generated carrier signal (e.g. a higher-frequency sinusoid). In this case, the resultant signal is then added to the chosen target band.

In applications that are intended to improve access to interaural temporal cues, a hearing-impaired person would be fitted with two hearing aids configured in the same way that would perform the processing outlined above. In this way, interaural low-frequency temporal fine structure-based cues could be transformed into interaural higher-frequency temporal envelope-based cues, which in turn would lead to an improvement in the person's spatial hearing abilities. To illustrate, consider a broadband sound source, e.g. a talker producing a consonant sound, which is displaced to one side of a listener. This source will give rise to IPDs, IEDs as well as interaural level differences. It is well known that, for normal-hearing listeners, low-frequency IPDs are the perceptually dominating interaural cues. Due to their sensorineural hearing losses, however, hearing-impaired listeners are compromised in terms of their abilities to benefit from these (temporal fine structure-based) types of spatial hearing cues. Nevertheless, their abilities to localize the sound source can be improved by transforming low-frequency IPDs into higher-frequency IEDs. In other words, with the help of the proposed processing method, the most potent type of (interaural) spatial hearing cue can be made available in a form, which hearing-impaired listeners still are sufficiently sensitive to. Consequently, their spatial hearing abilities should be enhanced.

Transformation of temporal fine structure-based cues into temporal envelope-based cues could also improve access to monaural temporal cues and would therefore also be relevant in situations where only one hearing aid was available. More specifically, by performing the type of processing outlined above unilaterally, monaural low-frequency temporal fine structure-based cues could be transformed into monaural higher-frequency temporal envelope-based cues, which in turn could lead to an improvement in a person's pitch hearing abilities, for example. To illustrate, consider a sound source that produces a periodic signal, e.g. a talker producing a vowel sound. It is well known that perceived pitch is related to the periodicity of a sound's waveform and therefore also to its fundamental frequency. Furthermore, normal-hearing listeners are known to rely heavily on pitch cues when listening to music as well as when segregating a target source from competing sound sources in more complex listening situations, for example. Due to their sensorineural hearing losses, however, hearing-impaired listeners are compromised in terms of their abilities to benefit from pitch cues, as these are conveyed by the temporal fine structure of an ear-input signal. Nevertheless, their abilities to determine a sound source's pitch can be improved by transforming the low-frequency monaural temporal fine structure-based cues into higher-frequency monaural temporal envelope-based cues. In other words, with the help of the proposed processing method, pitch cues can be made available in a form, which hearing-impaired listeners still are sufficiently sensitive to. Consequently, their pitch hearing abilities should be enhanced.

The invention is defined by the features of the independent claim(s). Preferred embodiments are defined in the dependent claims. Any reference numerals in the claims are intended to be non-limiting in their scope.

Some preferred embodiments have been shown in the foregoing, but it should be stressed that the invention is not limited to these, but may be embodied in other ways within the subject matter defined in the following claims.

References

Bernstein, L. R., and Trahiotis, C., "Detection of interaural delay in high-frequency sinusoidally amplitude-modulated tones, two-tone complexes, and bands of noise," J. Acoust. Soc. Am., 95, 3561-3567 (1994)

Bernstein, L. R., "Auditory processing of interaural timing information: New insights," J. Neurosc. Res., 66, 1035-1046 (2001)

Bernstein, L. R., and Trahiotis, C., "Enhancing sensitivity to interaural delays at high frequencies by using transposed stimuli," J. Acoust. Soc. Am., 112, 1026-1036 (2002)

Bernstein, L. R., and Trahiotis, C., "Enhancing interaural-delay-based extents of laterality at high frequencies by using transposed stimuli," J. Acoust. Soc. Am., 113, 3335-3347 (2003)

Bernstein, L. R., and Trahiotis, C., "Enhanced processing of interaural temporal disparities at high-frequencies: Beyond transposed stimuli," Proc. 14th Int. Symp. Hear., Cloppenburg, Germany, Aug. 18-23, pp. 368-374 (2006)

Blauert, J., "Spatial Hearing," Cambridge, Mass.: The MIT Press (1983)

Bregman, A. S., "Auditory Scene Analysis—The Perceptual Organization of Sound," Cambridge, Mass.: The MIT Press (1990)

Dau, T., Püschel, D., and Kohlrausch, A., "A quantitative model of the 'effective' signal processing in the auditory system. I. Model structure," J. Acoust. Soc. Am., 99, 3615-3622 (1996)

Dreyer, A., and Delgutte, B., "Phase locking of auditory-nerve fibers to the envelopes of high-frequency sounds: Implications for sound localization," J. Neurophysiol., 96, 2327-2341 (2006)

John, M. S., Dimitrijevic, A., and Picton, T., "Auditory steady-state responses to exponential modulation envelopes," Ear Hear., 23, 106-117 (2002)

Lacher-Fougere, S., and Demany, L., "Consequences of cochlear damage for the detection of interaural phase differences," J. Acoust. Soc. Am., 118, 2519-2526 (2005)

Lorenzi, C., Gilbert, G., Carn, H., Garnier, S., and Moore, B. C. J., "Speech perception problems of the hearing impaired reflect inability to use temporal fine structure," Proc. Nati. Acad. Sci. USA, 103, 18866-18869 (2006)

Meddis, R., and O'Mard, L., "A unitary model of pitch perception," J. Acoust. Soc. Am., 102, 1811-1820 (1997)

Moore, B. C. J., "Cochlear hearing loss," Chichester, UK: John Wiley & Sons Ltd (2007)

Shamma, S. A., "Topographic organization is essential for pitch perception," Proc. Natl. Acad. Sci. USA, 101, 1114-1115 (2004)

van de Par, S., and Kohlrausch, A., "A new approach to comparing binaural masking level differences at low and high frequencies," J. Acoust. Soc. Am., 101, 1671-1680 (1997)

Wightman, F. L., and Kistler, D. J., "The dominant role of low-frequency interaural time differences in sound localization," J. Acoust. Soc. Am., 91, 1648-1661 (1992)

The invention claimed is:

1. A hearing device, comprising:

an input transducer arrangeable at an ear of a user for converting an acoustic input to the hearing device into an input signal;

a filtering unit for providing a source signal based on a source band of said input signal and for providing a target signal based on a target band of said input signal, wherein said source band contains lower frequencies than said target band;

a modulation envelope unit for processing said source signal from said source band to generate a modulation envelope signal;

a signal combination unit for combining the modulation envelope signal with said target signal from said target band to generate a target output signal;

a signal processor configured to process a signal in a number of frequency bands, including said target band, and configured to provide a processed output signal based on the processed signals of said number of frequency bands; and an output transducer converting said processed output signal into an acoustic output to be provided to said ear of said user.

2. The hearing device according to claim 1, wherein said source band is arranged at frequencies lower than 500 Hz.

3. The hearing device according to claim 1, wherein said target band is in the range of 2 kHz to 4 kHz.

4. The hearing device according to claim 1, wherein said target band is chosen based on considerations of the user's hearing thresholds, and based on considerations of best sensitivity to temporal envelope-based cues.

5. The hearing device according to claim 1,
wherein said filtering unit is configured to provide a plurality of filter signals based on a plurality of filter bands, wherein
said source band and/or said target band are selected from said filter bands based on monitoring of said filter signals from said filter bands.

6. The hearing device according to claim 1,
wherein said modulation envelope unit is configured to apply halfwave rectification and lowpass filtering to said source signal from said source band to generate said modulation envelope signal.

7. The hearing device according to claim 6,
wherein a cut-off frequency of said lowpass filtering is in the range of 1 kHz to 2 kHz.

8. The hearing device according to claim 1,
wherein said modulation envelope unit is configured to raise a DC-shifted modulator to an exponent greater than or equal to one prior to multiplication with a modulation carrier to generate said modulation envelope signal.

9. The hearing device according to claim 1,
wherein said signal combination unit is configured to multiply said modulation envelope signal with a signal having a frequency higher than the target band.

10. The hearing device according to claim 9, wherein
said signal combination unit is configured to provide said signal having a frequency higher than the target band in the form of a carrier signal, and
is configured to add the multiplied modulation envelope signal to said target signal to generate said target output signal.

11. The hearing device according to claim 9,
wherein said signal combination unit is configured to multiply said modulation envelope signal with said target signal from said target band to generate said target output signal.

12. The hearing device according to claim 1,
wherein said signal combination unit includes an element for gain adjustment and/or filtering upon said generation of said target output signal.

13. A hearing aid system comprising a first hearing device and a second hearing device, each according to claim 1.

14. A method of configuring a hearing aid system, comprising the steps of:
converting a first acoustic input at a first ear of a user into a first input signal;
converting a second acoustic input at a second ear of a user into a second input signal;
providing a first source signal based on a first source band of said first input signal and providing a first target signal based on a first target band of said first input signal, wherein said first source band contains lower frequencies than said first target band;
providing a second source signal based on a second source band of said second input signal and providing a second target signal based on a second target band of said second input signal, wherein said second source band contains lower frequencies than said second target band;
processing said first and second source signals from said first and second source bands to generate first and second modulation envelope signals, respectively;
combining said first modulation envelope signal with said first target signal from said first target band to generate a first target output signal; and
combining said second modulation envelope signal with said second target signal from said second target band to generate a second target output signal.

15. The method according to claim 14 comprising processing signals from a first number of frequency bands, including said first target output signal of said first target band, and for providing a first processed output signal based on the processed signals of said first number of frequency bands.

16. The method according to claim 14 comprising processing signals from a second number of frequency bands, including said second target output signal of said second target band, and for providing a second processed output signal based on the processed signals of said second number of frequency bands.

17. The method according to claim 15 comprising converting said first and/or second processed output signal(s) into respective first and/or second acoustic output(s) to be provided to respective said first and/or second ear(s) of said user.

18. The method according to claim 14 wherein said target band is chosen based on considerations of the user's hearing thresholds and/or on considerations of best sensitivity to temporal envelope-based cues.

19. A computer-readable tangible medium encoded with instructions, wherein the instructions, when executed on a signal processor of a hearing device, cause the processor to perform a method comprising:
converting a first acoustic input at a first ear of a user into a first input signal;
converting a second acoustic input at a second ear of a user into a second input signal;
providing a first source signal based on a first source band of said first input signal and providing a first target signal based on a first target band of said first input signal, wherein said first source band contains lower frequencies than said first target band;
providing a second source signal based on a second source band of said second input signal and providing a second target signal based on a second target band of said second input signal, wherein said second source band contains lower frequencies than said second target band;
processing said first and second source signals from said first and second source bands to generate first and second modulation envelope signals, respectively;
combining said first modulation envelope signal with said first target signal from said first target band to generate a first target output signal; and
combining said second modulation envelope signal with said second target signal from said second target band to generate a second target output signal.

20. The hearing device according to claim 1, wherein
the frequency range of the acoustic input processed by the hearing device is between 10 Hz and 10 kHz.

* * * * *